US006802761B1

(12) United States Patent
Beaucage et al.

(10) Patent No.: US 6,802,761 B1
(45) Date of Patent: Oct. 12, 2004

(54) PATTERN-ELECTROPLATED LAPPING PLATES FOR REDUCED LOADS DURING SINGLE SLIDER LAPPING AND PROCESS FOR THEIR FABRICATION

(75) Inventors: Jacey R. Beaucage, San Jose, CA (US); Timothy C. Reiley, Los Gatos, CA (US); Huey-Ming Tzeng, San Jose, CA (US); Xiao Z. Wu, San Jose, CA (US)

(73) Assignee: Hitachi Global Storage Technologies Netherlands B.V., Amsterdam (NL)

( * ) Notice: Subject to any disclaimer, the term of this patent is extended or adjusted under 35 U.S.C. 154(b) by 0 days.

(21) Appl. No.: 10/392,630

(22) Filed: Mar. 20, 2003

(51) Int. Cl.[7] ..... B24B 1/00
(52) U.S. Cl. ..... 451/28; 451/550
(58) Field of Search ..... 451/28, 36, 63, 451/548, 549, 550; 438/692, 693; 216/88, 89, 39, 54

(56) References Cited

U.S. PATENT DOCUMENTS

| | | | | |
|---|---|---|---|---|
| 4,037,367 | A | 7/1977 | Kruse | |
| 4,866,886 | A | 9/1989 | Holmstrand | |
| 5,591,073 | A | 1/1997 | Turgeon | |
| 5,603,156 | A | 2/1997 | Biskeborn et al. | |
| 6,050,879 | A | 4/2000 | Dubrovskiy et al. | |
| 6,159,088 | A | 12/2000 | Nakajima | |
| 6,210,254 | B1 * | 4/2001 | Cook et al. | 451/36 |
| 6,439,986 | B1 | 8/2002 | Myoung et al. | |
| 2002/0083577 | A1 | 7/2002 | Suzuki | |
| 2002/0098779 | A1 | 7/2002 | Tsai et al. | |

FOREIGN PATENT DOCUMENTS

| | | |
|---|---|---|
| JP | 59001161 | 1/1984 |
| JP | 61214977 | 9/1986 |
| JP | 2009573 | 1/1990 |
| JP | 4-63351 | 5/1992 |
| JP | 6114724 | 4/1994 |
| JP | 6304860 | 11/1994 |
| JP | 09-117855 | 5/1997 |
| JP | 2001138212 | 5/2001 |

* cited by examiner

*Primary Examiner*—Dung Van Nguyen
(74) *Attorney, Agent, or Firm*—Robert B. Martin; Bracewell & Patterson, LLP

(57) ABSTRACT

A lapping plate has photolithographically defined patterns that are electroplated to produce lands with well-defined channels. By choosing a particular geometry, the retention force is significantly reduced over prior art options, while still retaining a high land area fraction. In some versions, the material is electroplated onto sufficiently thin substrates to allow conformation to a curved vacuum chuck. This configuration provides a very large reduction in retraction force when compared to smooth, flat lapping plates. In addition, the substrate used to form the lapping plate has reduced thickness, and a vacuum chuck is used to pull the thin, flat lapping plate against it to define the curvature. This allows the lapping plate to be charged by a flat charging ring. The substrate used is typically glass and has been sputter-metallized on both sides. The resist is then patterned, leaving an exposed pattern in the metallization on both sides.

18 Claims, 3 Drawing Sheets

PATTERN-ELECTROPLATED LAPPING PLATES FOR REDUCED LOADS DURING SINGLE SLIDER LAPPING AND PROCESS FOR THEIR FABRICATION

BACKGROUND OF THE INVENTION

1. Technical Field

The present invention relates in general to an improved apparatus and method of processing workpieces, and in particular to an improved process and apparatus for precision lapping a very small workpiece such as a single magnetoresistive slider.

2. Description of the Related Art

Magnetic recording is employed for large memory capacity requirements in high speed data processing systems. For example, in magnetic disc drive systems, data is read from and written to magnetic recording media utilizing magnetic transducers commonly referred to as magnetic heads. Typically, one or more magnetic recording discs are mounted on a spindle such that the disc can rotate to permit the magnetic head mounted on a moveable arm in position closely adjacent to the disc surface to read or write information thereon.

During operation of the disc drive system, an actuator mechanism moves the magnetic transducer to a desired radial position on the surface of the rotating disc where the head electromagnetically reads or writes data. Usually the head is integrally mounted in a carrier or support referred to as a "slider." A slider generally serves to mechanically support the head and any electrical connections between the head and the rest of the disc drive system. The slider is aerodynamically shaped to slide over moving air and therefore to maintain a uniform distance from the surface of the rotating disc thereby preventing the head from undesirably contacting the disc.

Typically, a slider is formed with essentially planar areas surrounded by recessed areas etched back from the original surface. The surface of the planar areas that glide over the disc surface during operation is known as the air bearing surface. Large numbers of sliders are fabricated from a single wafer having rows of the magnetic transducers deposited simultaneously on the wafer surface using semiconductor-type process methods. After deposition of the heads is complete, single-row bars are sliced from the wafer, each bar comprising a row of units which can be further processed into sliders having one or more magnetic transducers on their end faces. Each row bar is bonded to a fixture or tool where the bar is processed and then further diced, i.e., separated into sliders having one or more magnetic transducers on their end faces. Each row bar is bonded to a fixture or tool where the bar is processed and then further diced, i.e., separated into individual sliders each slider having at least one magnetic head terminating at the slider air bearing surface.

The slider head is typically an inductive electromagnetic device including magnetic pole pieces which read the data from or write the data onto the recording media surface. In other applications the magnetic head may include a magneto resistive read element for separately reading the recorded data with the inductive heads serving only to write the data. In either application, the various elements terminate on the air bearing surface and function to electromagnetically interact with the data contained on the magnetic recording disc. In order to achieve maximum efficiency from the magnetic heads, the sensing elements must have precision dimensional relationships to each other as well as the application of the slider air bearing surface to the magnetic recording disc. Each head has a polished air bearing surface (ABS) with flatness parameters, such as crown, camber, and twist. The ABS allows the head to "fly" above the surface of its respective spinning disk. In order to achieve the desired fly height, fly height variance, take-off speed, and other aerodynamic characteristics, the flatness parameters of the ABS need to be tightly controlled. During manufacturing, it is most critical to grind or lap these elements to very close tolerances of desired thickness in order to achieve the unimpaired functionality required of sliders.

Conventional lapping processes utilize either oscillatory or rotary motion of the workpiece across either a rotating or oscillating lapping plate to provide a random motion of the workpiece over the lapping plate and randomize plate imperfections across the head surface in the course of lapping. During the lapping process, the motion of abrasive particles carried on the surface of the lapping plate is typically along, parallel to, or across the magnetic head elements exposed at the slider air bearing surface. In magnetic head applications, the electrically active components exposed at the air bearing surface are made of relatively softer, ductile materials. These electrically active components during lapping can scratch and smear into the other components causing electrical shorts and degraded head performance. The prior art lapping processes cause different materials exposed at the slider air bearing surface to lap to different depths, resulting in recession or protrusion of the critical head elements relative to the air bearing surface. As a result, poor head performance because of increased space between the critical elements and the recording disc can occur.

Rotating lapping plates having horizontal lapping surfaces in which abrasive particles such as diamond fragments are embedded have been used for lapping and polishing purposes in the high precision lapping of magnetic transducing heads. Generally in these lapping processes, as abrasive slurry utilizing a liquid carrier containing diamond fragments or other abrasive particles is applied to the lapping surface as the lapping plate is rotated relative to the slider or sliders maintained against the lapping surface. Common practice is to periodically refurbish the lapping plate with a lapping abrasion to produce a surface texture suitable for the embedding and retention of the appropriate size of diamond abrasive being used with the lapping process. One of several problems experienced is that the surface is susceptible to rapid change in smoothness as it is used to lap a workpiece during lapping. A change in smoothness effects the hydrodynamic bearing film provided by the liquid component of the abrasive slurry creating a hydroplaning effect which raises the workpiece from the lapping surface to diminish the abrasion action of the particles and substantially increases abrasion time required.

The general idea of interrupting the lapping surface, for example, by forming grooves in the lapping plate is known in the art. Further, material has been used in the troughs so that unspent abrasive liquid is maintained adjacent to the working surface of the lapping plate while spent abrasive fluid is centrifugally removed beyond the lap plate periphery. In other applications, the grooves are formed between working surface areas in which an abrasive such as diamond particles are embedded in a metallic coat.

Problems exist with grooved plates such as excessive width and/or depth of the grooves to allow abrasive particles to lose their effectiveness due to lack of contact with a workpiece. Grooves that are too wide provide surface discontinuity too severe for small work pieces. Forming such grooves is costly and time consuming, even if the grooves can be sized properly. Substantial segments of the lapping surface remain ungrooved, or alternatively a prohibitively large number of grooves are required. Surface uniformity on a micropore scale suitable for lapping smaller pieces has been achieved only with extreme care. In addition, the efficiency of the lapping operation is directly related to the fraction of area at the upper surface since this is the area causing the lapping to occur.

Although a number of processing steps are required to manufacture heads, the ABS flatness parameters are primarily determined during the final lapping process. The final lapping process may be performed on the heads after they have been separated or segmented into individual pieces, or on rows of heads prior to the segmentation step. This process requires the head or row to be restrained while an abrasive plate of specified curvature is rubbed against it. As the plate abrades the surface of the head, the abrasion process causes material removal on the head ABS and, in the optimum case, will cause the ABS to conform to the contour or curvature of the plate. The final lapping process also creates and defines the proper magnetic read sensor and write element material heights needed for magnetic recording.

There are a number of factors that affect the accuracy of ABS curvature during the final lapping process. These include diamond size/morphology, lubricant chemistry, lapping surface velocity, plate material, lapping motion/path on the plate, and other lapping parameters. In addition to these parameters, three critical conditions must be satisfied. First, it is essential that the contour of the abrasive plate be tightly controlled since, in the best case, the ABS will conform to the curvature of the plate. In addition, all components of the process, including the head/row, must be restrained without distortion during lapping. Any variance in the restraining forces will cause the parts to distort and/or elastically deform upon removal of the forces. For example, if a head or row is lapped on an absolutely flat surface while it is clamped in a fixture, the part will elastically deform to a non-flat condition when it is released. The amount of deformation is proportional to the amount of elastic distortion created when the part was initially clamped.

The single slider lapping process (SSP) is a recent approach to improve the dimensional control of one of the key parameters for the magnetoresistive sensor in disk drives. In this process the individual slider is placed in a fixture and lapped until the desired resistance target is achieved. The slider is gripped on two ends, one of which has the electrical contacts pads which allow sensing of the desired resistance. It is necessary to apply sufficient force to the slider to maintain its position during lapping and to make electrical contact to the pads.

There is a countering factor opposing the application of large gripping force which is the need to avoid distorting the slider during gripping (whose relaxed state after lapping would retain the opposite distortion.) So there is a rationale to decrease the gripping force to the minimum. The distortion-causing load limit will be decreased by about 3× as a progression is made to femto sliders, and further reduction if a progression is made to a softer substrate material in the future (assuming crown/camber targets do not get tighter). Consequently, there will be an ever increasing emphasis on lower gripping forces as the SSP progresses. Thus, an improved apparatus and method for accurately defining the curvature of an ABS during the final lapping process is needed.

SUMMARY OF THE INVENTION

One embodiment of the present invention photolithographically defines patterns on a lapping plate which are electroplated to produce lands with well-defined channels. By choosing a particular geometry, the retention force is significantly reduced over prior art options, while still retaining a high land area fraction. The material may be electroplated onto sufficiently thin substrates to allow conformation to a curved vacuum chuck. Before electroplating resist is applied and patterned, an exposed pattern is left in the underlying metallization seed layer on both sides. A plasma cleaning step is used to clean the resist residue from the bottom of the holes, the plates are electroplated, and then the remaining resist is removed.

In one particular embodiment, the lapping plate is formed from a glass substrate, Cr—Cu sputtered, and has spun resist. Both sides of the substrate are patterned and plated (i.e., two lapping surfaces per substrate). The plate has 25 $\mu$m square lands with 10 $\mu$m spaces between lands, and has a 5 to 30 $\mu$m plating of Sn—Bi. The plate is press flattened or turned on both sides, and one of the lapping surfaces is initially resist-protected until it is used, which also isolates the plate electrically. The small land and space configuration gives rise to reduced hydrodynamic forces between the plate and workpiece as the workpiece is removed from the plate.

Another favorable aspect of the present invention is the reduced thickness of the substrate used for the lapping plate. It is desirable to use a vacuum chuck capable of pulling a thin, flat lapping plate against it to define the curvature. This allows the lapping plate to be charged with abrasive by a flat charging ring.

The foregoing and other objects and advantages of the present invention will be apparent to those skilled in the art, in view of the following detailed description of the preferred embodiment of the present invention, taken in conjunction with the appended claims and the accompanying drawings.

BRIEF DESCRIPTION OF THE DRAWINGS

So that the manner in which the features and advantages of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF A PREFERRED EMBODIMENT

Regarding single slider lapping processes (SSP), the inventors of the present invention have discovered that at least one important factor in the rationale for larger gripping forces is related to the hydrodynamic forces applied by the lapping fluid on the lapping plate as the slider or workpiece is removed after lapping. This slider unloading/retraction process significantly affects the overall lapped parameters and should be accomplished rather quickly to achieve the desired resistance target and to avoid edge or corner lapping or faceting during lifting of the slider. As the slider is retracted, the liquid lubricant fills the space between the lapping plate and the slider. Since this gap is extremely small (approximately 0.2 $\mu$m, depending somewhat on the diamond size) the shear forces needed to pump the lubricant into this space produce a pressure drop. This pressure drop is integrated into a force which acts to dislodge the slider from the lapping fixture. This is currently an important parameter which defines the gripping force necessary to avoid leaving the slider behind on the lapping plate.

One aspect of the present invention involves a means of patterning a lapping plate to reduce the hydrodynamic retention force which would tend to keep the finished slider from being pulled from the lapping plate. This structure is designed to allow liquid flow which reduces the pressure drop associated with filling the spaces between the flat slider and the upper areas (lands) on the lapping plate. Moreover, a lapping plate constructed in accordance with the present invention allows a well-defined land area fraction to be prescribed, which far exceeds conventional approaches. Furthermore, such a lapping plate can be made sufficiently thin to conform to a curved vacuum chuck to allow lapping under controlled crown/camber conditions.

Figure 1:
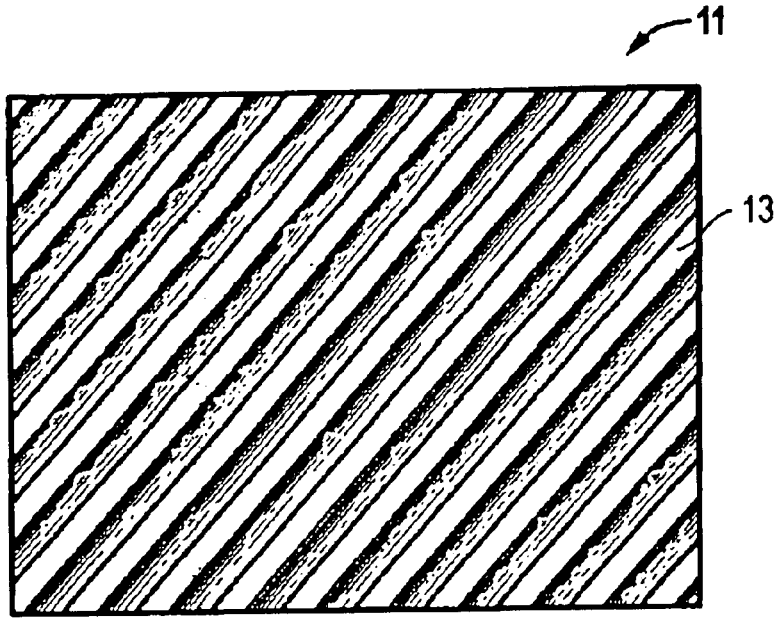
FIG. 1 (Prior Art)
FIG. 1 is a magnified plan view of a conventional grooved lapping plate.

Conventional lapping plates are typically textured or somewhat roughened and/or grooved. However, for reasons arising from the analysis below, flat, textured plates are unacceptable for minimum retraction force. Grooved plates have depressions which are cut into the lapping surface. An initial single slider lapping process (SSP) plan uses a plate 11 (FIG. 1) with an approximately 100 to 125 mm diameter, into which are cut regularly-spaced, circumferentially-spiral grooves 13. The grooves improve the removal of lapped material and reduce the retention force. However, as will be shown, a uni-directional groove pattern is less functional in reducing the retention force than the present invention. There are techniques, primarily associated with large lapping plates (approximately 350 mm in diameter), in which circular arc grooves are generated randomly upon the lapping surface.

Figure 2:
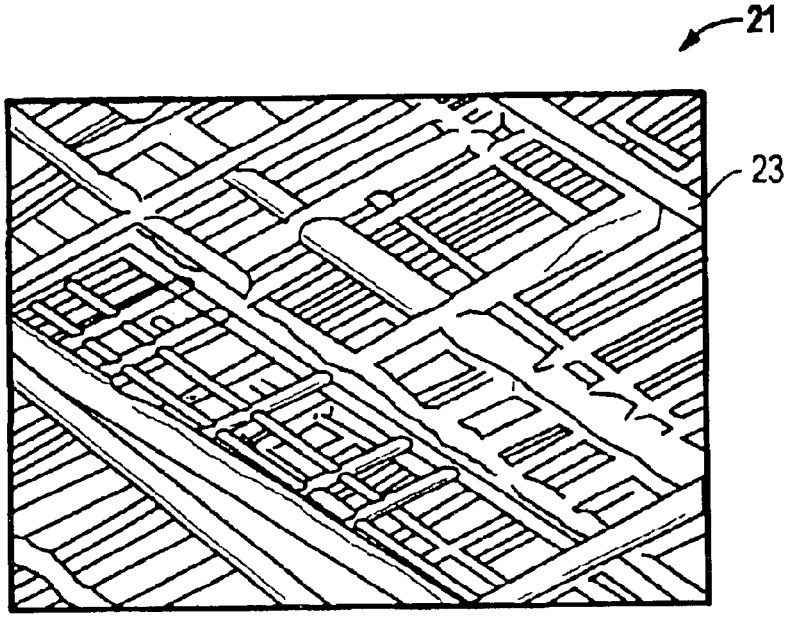
FIG. 2 (Prior Art)
FIG. 2 is a magnified plan view of a conventional cross-grooved lapping plate.

A problem associated with the amount of grooving necessary to generate a fully randomized grooved surface is that much of the surface area is no longer available to be charged by diamond. This is true since the charging process impresses diamond into only the outermost surfaces of the lapping plate. The reduced land area directly reduces the lapping rate since uncharged areas do not lap. A good target for land area fraction is about 50% or more, up to approximately 90%, although this far exceeds most current efforts for randomly grooved plates, which are typically 10 to 20% for a plates with a 14-inch diameter. One example of a plate 21 with random grooves 23 is shown in FIG. 2.

In contrast, the approach used with the present invention is to photolithographically define patterns on the lapping plate which are electroplated to produce lands with well-defined channels (analogous to grooves). By choosing a particular geometry, the retention force is significantly reduced over prior art options, while still retaining a high land area fraction. Furthermore, the material may be electroplated onto sufficiently thin substrates to allow conformation to a curved vacuum chuck.

Fluid Analysis and Retraction Force

Figure 3:
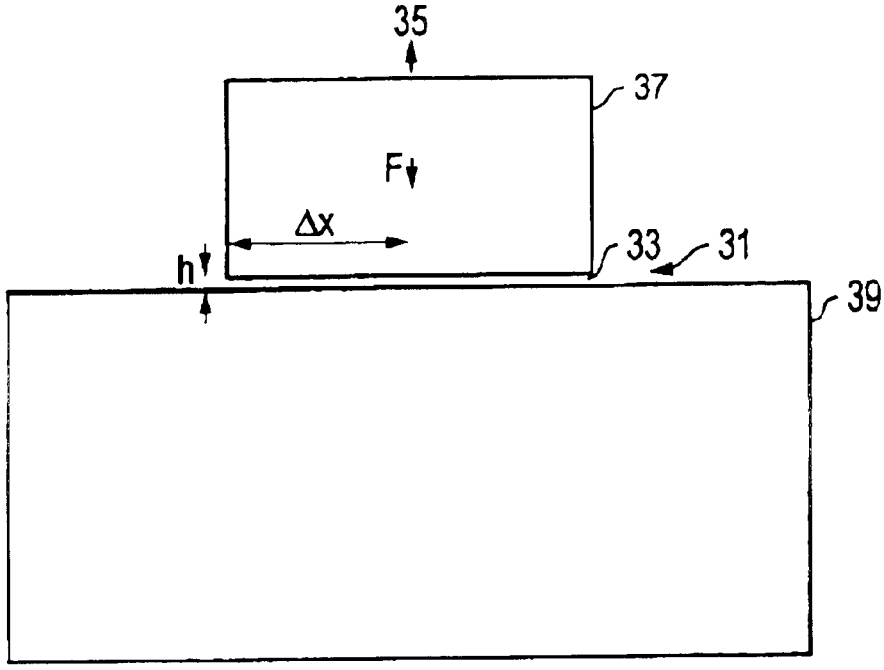
FIG. 3 is a side view diagram of the relationship between a lapping plate and a workpiece.

As two flat bodies are separated from each other in the presence of a liquid, the instantaneous separation rate will be determined by the rate at which the liquid fills the space. This analysis assumes no cavitation and that the liquid is incompressible. As shown in FIG. 3, a rough analogue is the flow of liquid 31 into a channel 33, for which it is known that the pressure drop $\Delta p$, over a channel length, L, with a channel depth, h, is given by: $\Delta p = 12\mu L q/h^3$, where q is the fluid flow rate ($m^2/s$) and $\mu$ is the viscosity (Pa-s). For this case in which the lapping plate is flat, the channel length is taken as half of the width or length of the slider 37, $\Delta x$, depending on the flow path. The pressure drop integrated over the slider area will result in a force, F, which tends to restrain the motion 35 of the slider in the vertical direction with respect to the plate 39.

The key observation from the above expression is the $h^{-3}$ dependence of the pressure drop. If grooves are present in the lapping plate, the pressure drop along the grooves (e.g., 5 to 10 $\mu$m deep) from the edge of the slider to the middle of the slider (approximately 0.5 mm), is quite small with respect to the pressure drop from the edge of a land to its center, even for a land dimension of 50 $\mu$m. This assumes a slider/land spacing of about 0.2 $\mu$m. Thus, the overall retention force is dominated by the delivery of liquid from the edge of the land to the center of the land and not by the fluid delivery along the grooves. It is also clear that if liquid can be delivered from all sides (as for an isolated land), rather than just two sides (as for an elongated land between two grooves), the pressure drop will be reduced. For example, the reduction in pressure drop over a square land versus the pressure drop over the same square area, if it is contained in the space between two grooves, is 4×.

The following analysis calculates retraction forces for three conditions for the sample case where a pico slider is being removed from a lapping plate at 50 $\mu$m/s. The first case is a flat lapping plate having no grooves, where all area is assumed to be land area separated from the slider by 0.2 $\mu$m. This configuration requires an enormous force to remove the slider from the lapping plate. In the second case, the lapping plate of the first case is provided with 50 $\mu$m grooves cut into the plate with 50 $\mu$m spaces between them. The third case is one embodiment of the present invention (FIG. 5) wherein a plate 51 has lands 53 which are substantially square with approximately 25 $\mu$m sides, and which are formed with spaces 61 between them that measure approximately 10 $\mu$m. In another embodiment, the lands may be round, hexagonal, or still other shapes having a major dimension of approximately 27 $\mu$m, such that adjacent ones of the lands are spaced apart from each other by a distance measuring approximately 10 $\mu$m to define channels therebetween. Plate 51 comprises, for example, a pattern-electroplated tin alloy on a glass substrate. The configuration of the third case has a 30× reduction in retraction force when compared to the second case, and over three orders of magnitude reduction over the first case. Much of this difference arises from the decrease in land size vis-a-vis the groove width. It would be possible to decrease the groove size and spacing in principle, however, this would lengthen the groove cutting time by 2×, requiring more groove cutting machines, more precision cutting bits, more setup, etc.

| Plate Type | Land Area % | Calc*. F (N) |
|---|---|---|
| Flat plate | 100 | 130 |
| Flat plate w/50 μm grooves | 50 | 0.56 |
| 25 μm lands/10 μm spaces | 50 | 0.018 |

One impact of the patterned plate is in the refinement and regularity of land features which can be obtained. For the lithographically-defined pattern, the limit is not defined by the mechanical perfection of a cutting bit or its lifetime, it is set by the minimum land spacing such that delivery of fluid in the channels between the lands to the center of the slider is not the high pressure drop component. For example, once the channel width becomes less than a few multiples of its depth, the channel walls must be considered in evaluating the pressure drop. Even so, channel dimensions on the order of 10 μm, with the lands being 25 μm square give relative pressure drops differing by over two orders of magnitude, with the pressure drop in the channel being negligible. Thus, the optimum patterned structure is one which supports the minimum land size and a large fraction of land area, and is readily manufactured.

Deformable Lapping Plates

Another favorable aspect of the present invention is the reduced thickness of the substrate which may be used for the lapping plate. It is desirable to use curved lapping plates to allow a pre-designated crown/camber curvature to be lapped into the slider. The machining of high quality curved plates to achieve this is an extra expense. For example, to prepare a plate with a 100 mm diameter to give a 10 nm crown, normalized to 1 mm, requires a 12.5 m associated radius of curvature on the plate, resulting in a 100 μm depression at the center with respect to the edges of the plate. Furthermore, the charging of a curved lapping plate becomes difficult, given that the charging ring or other device must have a precisely matched curvature. It is desirable to use a vacuum chuck capable of pulling a thin, flat lapping plate against it to define the curvature. This allows the lapping plate to be charged by a flat charging ring. The concept of using a vacuum chuck to produce curvature in a lapping plate is disclosed in U.S. Pat. No. 5,591,073, to Turgeon, which is incorporated herein by reference.

There is a limitation on the ability of a vacuum chuck to deform a plate. The thickness of the plate, t, having a radius, r, and Young's modulus, E, can be deformed to an seed layer, R, under a pressure, p, assuming a Poisson's ratio of ⅓. This relation is (see A Treatise on the Mathematical Theory of Elasticity, A. E. H. Love, 1927):

$$p=3E\ t^3/(R(r^2-3t^2))$$

Note the third power dependence of the pressure on the thickness of the plate. For a glass substrate (e.g., borosilicate glass) having a modulus of 65 GPa, and assuming 0.5 atm vacuum applied, the thickest 100 mm diameter plate which may be deformed to reach the 10 nm crown target described above is 2.0 mm. A tin plate could be about 50% thicker at 3 mm, given its lower modulus. However, to allow for some margin of safety, the tin lapping plate would have to be somewhat thinner, increasing its fragility to plastic deformation during handling. The choice of a 1 mm glass plate, as used in one embodiment of the present invention, allows even higher levels of crown to be achieved, if desired. The choice of 1 mm glass substrates is likely to be much cheaper than an approximately 2.5 mm solid tin substrate, if such thin tin plates are feasible. It is likely that glass disk technology could be used to generate cheap, flat, metallized, starting substrates.

Plate Fabrication

A range of experiments have been performed on patterned and unpatterned substrates involving glass, silicon, or Al—Mg, which were plated with Sn—Bi, Sn—Pb, or Sn. It is likely that a large number of substrate and plating material combinations will yield successful lapping plates. One embodiment of the present invention uses glass substrates which have been sputter-metallized with an adhesion layer such as Cr or Ti (10 nm), and a plateable layer such as Cu or Ni (90 nm), on both sides to provide or apply a seed layer for plate electroplating. In some applications involving a metal substrate such as alloys of tin or copper or nickel, no adhesion layer or seed layer may be needed. The resist is applied to both sides and may comprise, for example, a 15 to 50 μm thick laminated photo resist or, e.g., a 5 to 30 μm layer of spun photoresist. The resist is then patterned, leaving an exposed pattern in the metallization on both sides. A plasma cleaning step is used to remove the resist residue from the bottom of the holes, and then the plates are electroplated.

Figure 4:
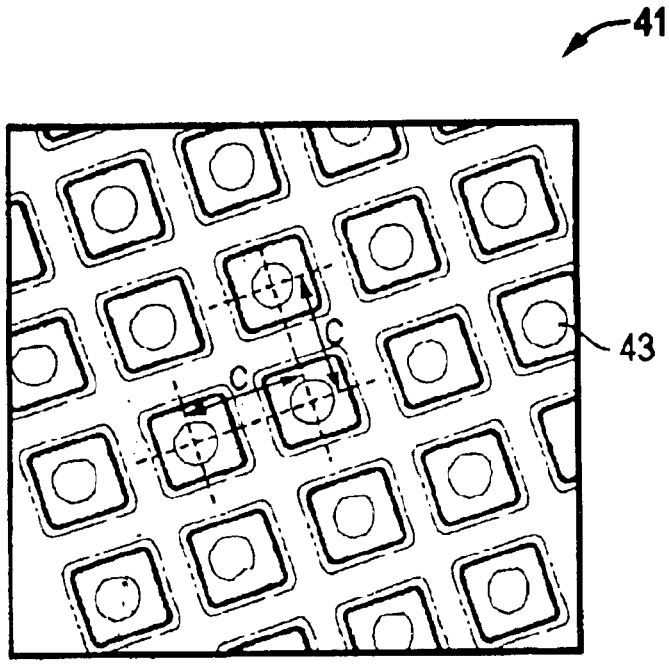
FIG. 4 is a plan view diagram of one embodiment of a lapping plate constructed in accordance with the present invention.
Figure 6:
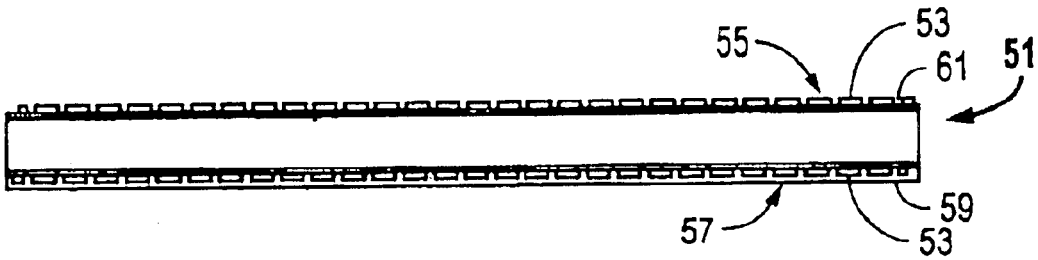
FIG. 6 is a schematic side view of the lapping plate of FIG. 4 and is constructed in accordance with the present invention.

There are at least two reasons for plating both sides of the substrates: (i) some intrinsic stress is usually generated in plated material and would cause some amount of curvature if plating were done only on one side; (ii) it is likely that both sides of the finished plate can be used, thereby roughly halving the plate cost. During the use of one side of the plate 51 (FIG. 6) as a lapping surface 55, the other side 57 including its lands 53 are protected by photoresist 59 or some other protective material. This also allows the vacuum chuck to effectively clamp the lapping plate in position. It is likely that only a very thin (approximately 5 to 30 μm) electroplated layer is needed. This is primarily dependent on the thickness uniformity of the material (e.g., thicker layers are likely to be less uniform). Therefore, it is also likely that spun photoresist can be used, which will make the pattern generation somewhat less expensive. FIG. 4 illustrates the patterned, laminated photoresist 41 which, in the version shown, has openings 43 that are 50 μm square. The centers of the openings 43 are spaced apart by a distance "c," which is 70 μm.

Figure 5:
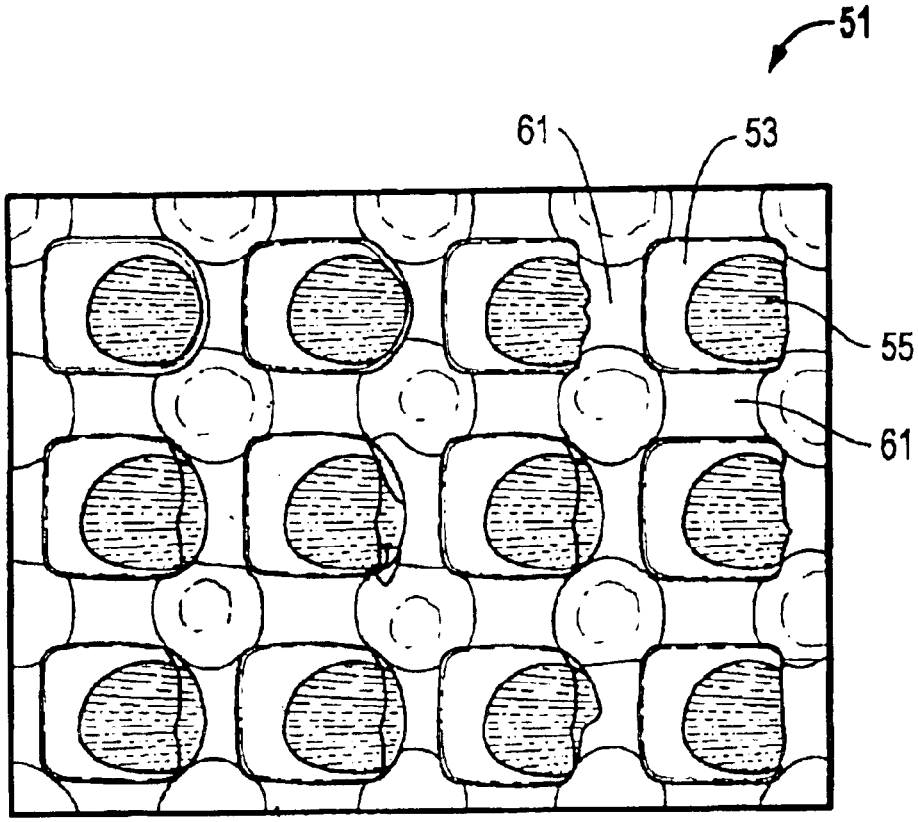
FIG. 5 is a magnified plan view of a portion of the lapping plate of FIG. 4 and is constructed in accordance with the present invention.

The electroplated material is a tin alloy having a plating bath compatible with the photoresist, and having a hardness that is greater than pure bulk tin. In an initial set of plated parts, the thickness was large and variable. This was improved with lower electroplating rates and thicknesses. However, given the possibility that thickness variation may be an intrinsic problem, two techniques for achieving the extreme flatness needed for a lapping plate were demonstrated. In the first technique, the plates were faced in a standard precision facing machine. The second approach used a hydraulic press which applied approximately 3 kpsi stress onto a sandwich comprising the double-side plated glass disks with mirror-polished SS plates on either side. This pressure was sufficient to compress most high regions of the soft tin lands on the plated parts. As shown in FIG. 5, a plate 51 was treated in this way, has lands 53, and was charged with diamond 55. In this experiment, the charging level was not high nor very uniform, but was sufficient to lap sliders. The resulting lapping rate was good and some of the sliders showed reasonable parameters. Again, one version of the plate pattern has 25 μm square lands with 10 μm spaces between adjacent lands. See FIG. 5. The retention force for this structure would be about 1/30th of the prior art sample (i.e., the second case, described above, which had 50 μm grooves, 50 μm spaces).

The present invention has several advantages. The method of the present invention photolithographically defines patterns on a lapping plate which are electroplated to produce lands with well-defined channels. By choosing a particular geometry, the retention force is significantly reduced over prior art options, while still retaining a high land area fraction. The resist is then patterned, leaving an exposed pattern in the underlying metallization on both sides. A plasma cleaning step is used to clean the resist residue from the bottom of the holes, and then the plates are electroplated.

Another favorable aspect is the reduced thickness of the substrate used for the lapping plate. It is desirable to use a vacuum chuck capable of pulling a thin, flat lapping plate against it to define the curvature. This allows the lapping plate to be charged with abrasive by a flat charging ring. The lapping plate apparatus of the present invention provides excellent lap processing of small workpieces such as individual sliders, while reducing the retraction force relative to the workpieces by thirty-fold when compared to the reference grooved lapping plates.

While the invention has been shown or described in only some of its forms, it should be apparent to those skilled in the art that it is not so limited, but is susceptible to various changes without departing from the scope of the invention.

What is claimed is:

1. A method of forming a lapping plate for use in processing a workpiece, comprising:

(a) providing a substrate having a pair of lapping surfaces that are located on opposite sides of the substrate;

(b) applying resist to both lapping surfaces of the substrate;

(c) photolithographically preparing a pattern of lands on each of the lapping surfaces of the substrate, such that the lands comprise approximately 50% to 90% of a total surface area of the lapping surfaces of the substrate;

(d) plating both lapping surfaces of the substrate;

(e) charging the lands with an abrasive;

(f) protecting one of the lapping surfaces of the substrate with a protective layer until said one of the lapping sides is ready to be used in a lapping process; and (g) deforming the substrate into a curved shape imposed by a vacuum chuck such that the substrate has an induced crown and camber, and an seed layer with a depression in a center of the substrate.

2. The method of claim 1 wherein the photolithographing step (c) comprises electroplating a tin alloy on the substrate to form the lands.

3. The method of claim 1 wherein the applying step (b) comprises adding a 15 to 50 $\mu$m thick laminated photo resist to each lapping surface of the substrate.

4. The method of claim 1 wherein the applying step (b) comprises spinning a 5 to 30 $\mu$m layer of photo resist to each lapping surface of the substrate.

5. The method of claim 1 wherein the substrate is initially flat, and the charging step (e) comprises charging the lands with a flat charging ring prior to the deforming step (g).

6. The method of claim 1 wherein the providing step (a) comprises forming the substrate from glass having a thickness in a range of approximately 1 to 2 mm.

7. The method of claim 1 wherein the providing step (a) comprises forming the substrate from tin having a thickness in a range of approximately 2 to 3 mm.

8. The method of claim 1 wherein the photolithographing step (c) comprises forming the lands in a substantially square shape having sides measuring approximately 25 $\mu$m, such that adjacent ones of the lands are spaced apart from each other by a distance measuring approximately 10 $\mu$m to define channels therebetween.

9. The method of claim 1 wherein the photolithographing step (c) comprises forming the lands in a round shape having diameters measuring approximately 27 $\mu$m, such that adjacent ones of the lands are spaced apart from each other by a distance measuring approximately 10 $\mu$m to define channels therebetween.

10. The method of claim 1 wherein the photolithographing step (c) comprises forming the lands in a hexagonal shape, such that adjacent ones of the lands are spaced apart from each other by a distance measuring approximately 10 $\mu$m to define channels therebetween.

11. The method of claim 1, further comprising the step of applying a seed layer to both lapping surfaces of the substrate.

12. The method of claim 11 wherein the plating a seed layer step comprises sputter metallizing both lapping surfaces with an adhesion layer such as Cr or Ti, and a plateable layer such as Cu or Ni.

13. A method of forming a lapping plate for use in processing a workpiece, comprising:

(a) providing a substrate that is initially flat and has thickness in a range of 1 to 3 mm, and a pair of lapping surfaces that are located on opposite sides of the substrate;

(b) providing a seed layer on both lapping surfaces of the substrate for later electroplating;

(c) applying resist to both lapping surfaces of the substrate;

(d) electroplating a metal alloy pattern of square-shaped lands on each of the lapping surfaces of the substrate, such that the lands are spaced apart from each other by regular intervals, and the lands comprise approximately 50% to 90% of a total surface area of the lapping surfaces of the substrate;

(e) protecting one of the lapping surfaces of the substrate with a protective layer until said one of the lapping sides is ready to be used in a lapping process;

(f) charging the lands with an abrasive with a flat charging ring; and then (g) deforming the substrate into a curved shape imposed by a vacuum chuck such that the substrate has an induced crown and camber, and an associated radius of curvature with a depression in a center of the substrate.

14. The method of claim 13 wherein the applying step (c) comprises adding a 15 to 50 $\mu$m thick laminated photo resist to each lapping surface of the substrate.

15. The method of claim 13 wherein the applying step (c) comprises spinning a 5 to 30 $\mu$m layer of photo resist to each lapping surface of the substrate.

16. The method of claim 13 wherein the providing step (b) comprises sputter metallizing both lapping surfaces with a 10 nm layer of Cr or Ti, and then a 90 nm layer of Cu or Ni.

17. The method of claim 13 wherein the providing step (a) comprises forming the substrate from a material selected from the group consisting of glass having a thickness of 1 to 2 mm, and tin having a thickness of 2 to 3 mm.

18. The method of claim 13 wherein the electroplating step (d) comprises forming the lands with sides measuring approximately 25 $\mu$m, such that adjacent ones of the lands are spaced apart from each other by a distance measuring approximately 10 $\mu$m to define channels therebetween.

* * * * *